United States Patent [19]

Bouchard et al.

[11] 3,947,223

[45] Mar. 30, 1976

[54] PHOTOFLASH LAMP

[75] Inventors: Andre C. Bouchard, Peabody; John F. Waymouth, Marblehead; Thomas J. Sentementes, Wakefield; Naila Saba Jirmanus, Somerville, all of Mass.

[73] Assignee: GTE Sylvania Incorporated, Danvers, Mass.

[22] Filed: July 10, 1974

[21] Appl. No.: 487,353

[52] U.S. Cl. ..... 431/94; 431/95 R

[51] Int. Cl.[2] ..... F21K 5/02

[58] Field of Search ..... 431/93–95

[56] References Cited

UNITED STATES PATENTS

| | | | |
|---|---|---|---|
| 3,506,385 | 4/1970 | Weber et al. | 431/95 |
| 3,607,789 | 9/1971 | Murthy et al. | 106/47 R |
| 3,676,043 | 7/1972 | Anderson et al. | 431/93 |
| 3,723,790 | 3/1973 | Dumbaugh et al. | 431/95 |
| 3,829,303 | 8/1974 | Zeto et al. | 106/47 R |

OTHER PUBLICATIONS

Inorganic Glass-forming Systems by H. Rawson, published 1967, by Academic Press, N.Y., N.Y., pp. 98 and 103–106.

*Primary Examiner*—Carroll B. Dority, Jr,
*Attorney, Agent, or Firm*—Edward J. Coleman

[57] ABSTRACT

A photoflash lamp having a glass envelope with an inner layer or coating of a material selected to have a low thermal conductivity and diffusivity for minimizing heat losses during the collision of molten droplets of combustible metal with the inner wall of the envelope during flashing. In this manner, radiative energy losses resulting from the droplet-wall collisions are minimized and light output is improved.

25 Claims, 4 Drawing Figures

PHOTOFLASH LAMP

BACKGROUND OF THE INVENTION

This invention relates to photoflash lamps and, more particularly, to flashlamps containing a combustible material which is ignited to produce actinic light.

A typical photoflash lamp comprises an hermetically sealed glass envelope containing a quantity of combustible metal, such as shredded zirconium or hafnium foil, and a combustion supporting gas, such as oxygen, at a pressure well above one atmosphere. In lamps intended for battery operated flash systems, the envelope also includes an electrical ignition system comprising a tungsten filament supported on a pair of lead-in wires having a quantity of ignition paste on the inner ends thereof adjacent to the filament. This type of lamp is operated by the passage of an electrical current through the lead-in wires which incandesces the filament to ignite the ignition paste which in turn ignites the combustible metal in the envelope. In the case of percussive-type photoflash lamps, such as described in U.S. Pat. No. 3,535,063, a mechanical primer is sealed in one end of the lamp envelope. The primer may comprise a metal tube extending from the lamp envelope and a charge of fulminating material on an anvil wire supported in the tube. Operation of the percussive photoflash lamp is initiated by an impact onto the tube to cause deflagration of the fulminating material up through the tube to ignite the combustible metal disposed in the lamp envelopes.

During lamp flashing, the rapid combustion process causes molten droplets of metal and metal oxide to be ejected from the burning strands of combustible metal and to impinge upon the inner walls of the glass envelope. The radiative energy of these molten droplets is directly related to the light output characteristics of the flashlamp, and it has long been recognized that each droplet-wall collision results in a substantial loss of radiative energy from the molten droplet with an attendant diminishing of light output. For example, U.S. Pat. No. 3,377,126 of Nijland et al views this problem from the standpoint of the light absorbing deposits which collect on the inner wall of the envelope during flashing. After the molten droplets collide with the glass wall, there often remains gray or blackish deposits which appear as wall encrustations of approximately 0.2 mm to 1.0 mm in diameter, apparently the result of non-quantitative combustion products. Such deposits can clearly reduce light output by masking or optically attenuating radiation within the lamp vessel. Further, the deposits contain incompletely reacted zirconium or hafnium which is lost for the generation of useful light. The problem is compounded by the current trend to smaller lamp envelope sizes, as the resulting shorter paths of travel for ejected molten droplets mean the resulting droplets will be even less completely burned out prior to colliding with the envelope wall. The use of excess oxygen to alleviate these problems has generally proved ineffective as a remedy.

The Nijland et al. U.S. Pat. No. 3,377,126 attacks the problem by proposing the use of colorless inner wall coatings which release gaseous dissociation products which react with the combustible material "so that the bulb wall cannot be affected or darkened by incompletely burned reducing reaction products". Gains in brightness of over 20% are claimed for applications of multiple coatings of inorganic substances and organic polymers. Suitable inorganic substances proposed are colorless oxygen-releasing compounds such as nitrates, chlorates and perchlorates; whereas the proposed organic substances are colorless, polymeric, fluorated hydrocarbon compounds which evaporate or dissociate at a relatively low temperature. Hence, it appears that the Nijland et al patent provides a vapor or oxygen "cushion" about the inner wall which apparently delays droplet-wall collisions and the condensation or combustion products on the envelope wall.

The most obvious disadvantages of the application of organic coatings, as proposed by the Nijland et at patent, is the possible danger of increasing internal lamp pressures during flashing, expecially in miniaturized lamps with volumes less than 1 cc. These small vessels typically contain fill pressures in excess of five atmospheres and any additions of hydrocarbons would certainly increase the probability of containment failure. Additions of inorganic substances, such as the evaporable solutions of perchlorates suggested by the Nijland patent, would add to lamp manufacturing difficulties and pose problems with retainment of water during lamp processing which would seriously affect light output characteristics.

U.S. Pat. No. 3,630,650 of Kaufmann et al., on the other hand, views the problem of radiative energy losses as due to the heat sink effect of the glass with respect to the burning metal strands and controls shred configuration to minimize these undesired energy losses. More specifically, the Kaufmann et al patent proposes the use of crumpled shreds to promote "optimum combustion without energy losses due to extensive heat transmission to the glass". The process of crumpling provides sharp bends in the shreds which are intended to reduce the bearing area of the combustible material on the inner wall of the lamp envelope. Light output gains of up to 40% are claimed. Nevertheless, the Kaufmann approach still prevents only a fraction of the incompletely reacted droplets from striking the inner lamp walls. Our measurements have shown that losses in brightness of approximately 40–50% occur via wall collision losses, even in the case of flashlamps employing the teachings of Kaufmann.

SUMMARY OF THE INVENTION

In view of the foregoing, a principal object of this invention is to provide a photoflash lamp having improved light output characteristics.

A particular object of the invention is to provide a flashlamp having improved means for minimizing the radiative energy losses resulting from droplet-wall collisions.

These and other objects, advantages and features are attained, in accordance with the invention, by providing an envelope material selected to minimize heat losses occuring during the collision of molten droplets of the combustible material with the inner wall of the envelope during flashing. More specifically, we have discovered that the thermal conductivity and thermal diffusivity properties of a photoflash envelope, i.e., the impingement surface of the droplet, are of significant importance in determining the extent of a radiative energy that will be lost as a result of droplet-wall collision. We have found that the lower the thermal conductivity and thermal diffusivity properties are, the lower the energy losses from the droplet will be during impingement against the inner wall of the lamp envelope. By providing at least a thin inner layer of this selected material on the interior surface of the lamp envelope, we have found that photoflash brightness losses can be reduced to a marked degree, to thereby yield a significant gain in the light output of photoflash lamps. Preferably, the selected material is an inorganic glass of very low thermal conductivity and low thermal diffusivity, such as a lanthanum borate, lead borate or lead borogermanate glass, which is coated and/or fused onto the interior surface of a much thicker layer of the primary glass envelope material.

Thus, whereas the Nijland et al patent counters radiative energy losses associated with droplet-wall collisions by providing an inner wall coating of organic and/or inorganic materials which give off gas dissociation products to apparently delay droplet collision with and condensation upon the envelope walls, we provide an inner wall coating or layer, preferably of an inorganic material, which is selected to minimize heat losses during the collision of the molten droplets with the wall. That is, whereas the Nijland et al. coating is selected to react with the molten droplets, we control the inner surface composition of the envelope to extend the radiative energy life of the colliding burning droplet. Further, our selected inner layer material causes colliding droplets to be cooled less upon impinging against the envelope wall, whereupon the molten droplet leaves substantially less material as a wall deposit or encrustation. Accordingly, the masking effect of wall deposits is reduced and light output is enhanced.

The Kaufmann et al patent, on the other hand, counters energy losses to the glass envelope by controlling the configuration of the combustible metal shreds to reduce their bearing surface area upon the envelope wall and thus minimize the heat sink effect of the glass envelope with respect to ignited shreds. In contrast, we control the surface composition of the inner wall of the envelope to extend the radiative life of the burning droplets. Accordingly, we can obtain significant gains in light output without any alterations in the quantity, configuration or arrangement of the fuels or oxidants presently used in flashlamps.

BRIEF DESCRIPTION OF THE DRAWINGS

This invention will be more fully described hereinafter in conjunction with the accompanying drawings, in which.

DESCRIPTION OF PREFERRED EMBODIMENT

The teachings of the present invention are applicable to either percussive or electrically ignited photoflash lamps of a wide variety of sizes and shapes; however, it is particularly useful with respect to flash lamps having tubular shaped envelopes with a volume of less than 1 cubic centimeter (cc.). Accordingly, FIGS. 1 and 2 respectively illustrate electrically ignited and percussive-type photoflash lamps embodying the principles of the invention.

Figure 1:
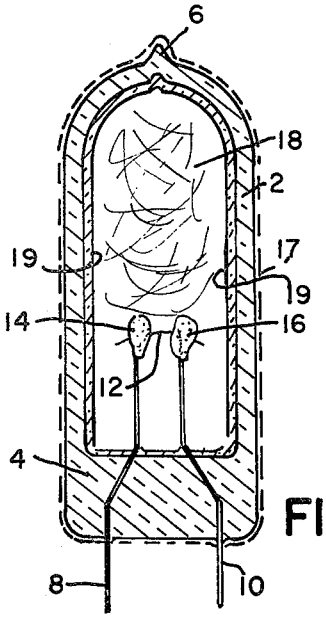
FIG. 1 is an enlarged sectional elevation of an electrically ignitable photoflash lamp having an envelope with an inner layer of a material selected in accordance with the invention.

Referring to FIG. 1, the electrically ignitable lamp comprises an hermetically sealed lamp envelope including a primary layer of glass tubing 2 having a press 4 defining one end thereof and an exhaust tip 6 defining the other end thereof. Supported by the press 4 is an ignition means comprising a pair of lead-in wires 8 and 10 extending through and sealed into the press. A filament 12 spans the inner ends of the lead-in wires, and beads of primer 14 and 16 are located on the inner ends of the lead-in wires 8 and 10, respectively, at their junction with the filament. Typically, the lamp envelope has an internal diameter of less than one-half inch, and an internal volume of less than 1 cc., although the present invention is equally suitable for application to larger lamp sizes. The exterior surface of the glass envelope is covered with a protective coating 17 (denoted by dashed lines) such as cellulose acetate lacquer or a vacuum-formed thermoplastic coating, such as described in U.S. Pat. No. 3,770,366. A combustion-supporting gas, such as oxygen, and a filamentary combustible metal 18, such as shredded zirconium or hafnium foil, are disposed within the lamp envelope. Typically, the combustion-supporting gas fill is at a pressure exceeding about 500 centimeters of mercury, and the lamp is loaded with at least about 18 milligrams of the filamentary combustible metal. In accordance with the invention, the lamp envelope also includes an inner layer of a light-transmitting material 19 which is coated and/or fused onto the inner surface of the primary layer of glass 2 and is selected to minimize heat losses during flashing, as shall be described in more detail hereinafter.

Figure 2:
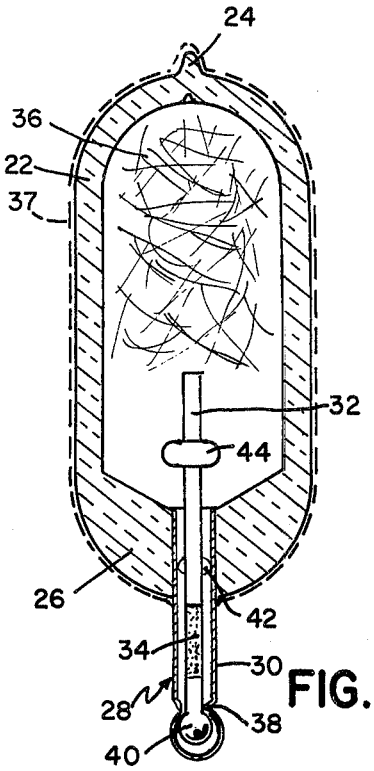
FIG. 2 is an enlarged sectional elevation of a percussive-type photoflash lamp having an envelope of a material selected in accordance with the invention.

The percussive-photoflash lamp illustrated in FIG. 2 comprises a length of light-transmitting tubing defining an hermetically sealed lamp envelope 22 constricted at one end to define an exhaust tip 24 and shaped to define a seal 26 about a primer 28 at the other end thereof. In accordance with the invention, envelope 22 comprises a material selected to minimize heat losses during flashing, as shall be described in more detail hereinafter. The primer 28 comprises a metal tube 30, a wire anvil 32, and a charge of fulminating material 34. A combustible metal 36, such as filamentary zirconium or hafnium, and a combustion-supporting gas, such as oxygen, are disposed within the lamp envelope with the fill gas typically being at a pressure of greater than about 500 cm. Hg. and the quantity of combustible metal fill being at least about 18 mgs. The exterior surface of the glass envelope is covered with a protective coating 37, such as cellulose acetate lacquer or a vacuum-formed thermoplastic.

The wire anvil 32 is centered within the tube 30 and is held in place by a circumferential indenture 38 of the tube 30 which loops over the head 40, or other suitable protuberance, at the lower extremity of the wire anvil. Additional means, such as lobes 42 on wire anvil 32 for example, may also be used in stabilizing the wire anvil, supporting it substantially coaxial within the primer tube 30 and insuring clearance between the fulminating material 34 and the inside wall of tube 30. A refractory or metal bead 44 is located on the wire anvil 32 just above the inner mouth of the primer tube 30 to eliminate tube 30 burn-through and function as a deflector to deflect and control the ejection of hot gases from the fulminating material in the primer. The lamp of FIG. 2 is also typically a subminiature type having envelope dimensions similar to those described with respect to FIG. 1.

Although the lamp of FIG. 1 is electrically ignited, usually from a battery source, and the lamp of FIG. 2 is percussion-ignitable, the lamps are similar in that in each the ignition means is attached to one end of the lamp envelope and disposed in operative relationship with respect to the filamentary combustible metal 18 or 36. More specifically, the igniter filament 12 of the flash lamp in FIG. 1 is incandesced electrically by current passing through the metal filament support leads 8 and 10, whereupon the incandescent filament 12 ignites the beads of primer 14 and 16 which in turn ignite the combustible metal 18 disposed within the lamp envelope. Operation of the percussive-type lamp of FIG. 2 is initiated by an impact onto tube 30 to cause deflagration of the fulminating material 34 up through the tube 30 to ignite the combustible metal 36 disposed within the lamp envelope.

Ignition of the filamentary combustible metal 18 or 36 produces an array of burning droplets of metal and metal oxide which impinge against the envelope walls. The typical droplet radius is from 50–100 microns. Pursuant to extensive experimentation, we have closely studied the kinetics of combustion involved in the collison of such droplets with a variety of wall materials. To our surprise, we discovered that the composition of the inner surface of the envelope wall determined to a significant extent the radiating life time of the burning droplet subsequent to collision. For example, droplets were essentially extinguished when striking a sapphire surface, while the radiative energy of droplets colliding with a mica surface was insignificantly affected. More interestingly, a close correlation was found to exist between the thermal conductivity of the impingement surface and the droplet energy losses during collision. Thermal diffusivity was also found to be a significant contributing factor. Accordingly, we have determined that the radiative energy losses resulting from droplets colliding with the envelope walls of an ignited photoflash lamp can be significantly minimized by selecting an envelope material which will minimize the conductive heat losses occuring during droplet-wall collisions. In particular, envelope materials having a low thermal conductivity, that is, less than $24 \times 10^{-4}$ cal/cm-sec-°C at 100°C, and/or a low thermal diffusivity, that is, less than $50 \times 10^{-4}$ cm²/sec at 100°C, have been found especially suitable for this purpose. Thus, FIG. 1 illustrates one embodiment of the invention wherein a thin inner layer 19 of a material selected to minimize conductive heat losses is coated and/or fused onto a primary layer 2 of a different material. Typically, primary layer 2 is a soft glass of the type conventionally used for flashlamp envelopes, and the thermal conductivity and/or thermal diffusivity of the inner layer material 19 are respectively less than the thermal conductivity and/or thermal diffusivity of the primary layer material 2. FIG. 2, on the other hand, illustrates another embodiment wherein the entire glass envelope 22 (exclusive of the exterior plastic coating 37) is composed of the selected low conductivity material.

Preferably, the selected material 19 or 22 is inorganic and has a thermal conductivity which is less than about $20 \times 10^{-4}$ cal/cm-sec-°C at 100°C and a thermal diffusivity of less than about $30 \times 10^{-4}$ cm²/sec at 100°C. Among the materials found particularly suitable for this application are lanthanum borate glasses, lead borogermanate glasses and lead borate glasses. For example, lanthanum borate glass having a composition (percent by weight) of 20.7% $La_2O_3$, 27.6% $B_2O_3$, 20.7% BaO, 20.7% ZnO and 10.3% $TiO_2$ has been determined to have a thermal conductivity of about $19.1 \times 10^{-4}$ cal/cm-sec-°C at 100°C and a thermal diffusivity of about $22.7 \times 10^{-4}$ cm²/sec at 100°C; lead borogermanate glass having a composition of 64% $GeO_2$, 16% PbO and 20% $B_2O_3$ has been determined to have a thermal conductivity of about $15.3 \times 10^{-4}$ cal/cm-sec-°C at 100°C and a thermal diffusivity of about $21.9 \times 10^{-4}$ cm²/sec at 100°C; and lead borate glass having a composition of 76.2% PbO and 23.8% $B_2O_3$ has been determined to have a thermal conductivity of about $15.0 \times 10^{-4}$ cal/cm-sec-°C at 100°C and a thermal diffusivity of about $16.7 \times 10^{-4}$ cm²/sec at 100°C. The above mentioned lead borogermanate glass composition is the subject of a copending application Ser. No. 487,076, now U.S. Pat. No. 3,897,197 filed on even date herewith and assigned to the present assignee. It is to be understood, however, that the present invention is not limited to the use of low conductivity glass, for it is contemplated that a number of light-transmitting materials are available having the desired characteristics particularly suitable for minimizing the heat losses occuring during droplet-wall collision.

FIG. 2 illustrates an embodiment wherein the selected low conductivity material comprises the entire lamp envelope 22 exclusive of the outer plastic coating. Depending upon the application and the particular material selected, however, this construction may prove relatively unfeasible from a cost or design standpoint. Accordingly, in certain applications the embodiment of FIG. 1 may be preferred wherein the low conductivity material is coated and/or fused as an inner layer 19 of the lamp envelope. The minimum thickness of layer 19 for providing an effective barrier to thermal losses into the envelope wall upon collision by a burning droplet of metal for a fraction of millisecond may be calculated by approximated means considering the duration of droplet wall contact and the thermal conductivity, density and heat capacity of the impinged envelope material. For example, for a set of typical subminiature flashlamp parameters and an assumed collision duration of about 0.1 millisecond, we determined a minimum layer thickness of about 10 microns. In general, however, the thickness of inner layer 19 will range from one to three mils, with the primary layer of glass being several times thicker than the inner layer (e.g., of the order of 24 mils) as illustrated by the greatly enlarged wall cross-section of FIG. 3.

The mean coefficient of thermal expansion of the inner layer 19 is substantially matched to or less than the mean coefficient of thermal expansion of the primary layer 2. For example, a typical primary layer glass is Corning type 0010, which has a mean coefficient of thermal expansion of about $93 \times 10^{-7}$ in./in./°C between 0° and 300°C. If it is desired that the low conductivity coating provide an expansion match with this glass, a lead borate glass having a composition (percent by weight) such as 76.2% PbO and 23.8% $B_2O_3$ may be employed as inner layer 19, as it has approximately the same coefficient of thermal expansion. On the other hand, it is often desired that the thin inner layer 19 have a lower coefficient of thermal expansion than prmary layer 2, whereby layer 19 will be in a state of compression to provide added strength. In such a case, suitable materials for the inner layer 19 include a lanthanum borate glass having a composition (percent by weight) such as 20.7% $La_2O_3$, 27.6% $B_2O_3$, 20.7% BaO, 20.7% ZnO and 10.3% $TiO_2$ and a lead borogermanate glass having a composition (percent by weight) such as 64% $GeO_2$, 16% PbO and 20% $B_2O_3$, each of which have been measured as having a mean coefficient of thermal expansion of about 68 to $70 \times 10^{-7}$ in./in./°C between 0° and 300°C.

In one embodiment of the invention, electrically ignitable flashlamps of the type shown in FIG. 1 were provided by coating a layer of lanthanum borate glass of the composition set forth above, on the inner surface of Corning type 0010 tubular glass sleeves of the size employed for making tubular flashlamp envelopes having an internal volume of 0.78 cc. More specifically, the lanthanum borate glass was ground to a particle size of 100 to 200 mesh and suspended in an organic binder system, such as ethyl cellulose lacquer. This liquid suspension was then coated on the inner surface of the glass sleeve, after which the coating was dried by forced air and then flame-fused to the 0010 glass. Preferably, the coating is heated to just below the softening temperature of the 0010 glass during fusing. In addition to fusing the coating to the substrate glass, this process serves to bake off the organic binder. The ignition structure was then press-sealed into one end of the glass sleeve, and the lamp was loaded with 30 mgs. of shredded zirconium foil comprising four inch crumpled strands having a cross-section of approximately $0.95 \times 1.3$ mils. Thereafter the lamp was filled with oxygen and tipped off, the initial oxygen fill pressure being about 675 cm. Hg. The resulting tubular lamp envelope had an outside diameter of 0.4 inch, with the primary layer 2 of Corning 0010 glass having a thickness of about 35 mils and the inner layer 19 of lanthanum borate glass being about 0.5 mil thick. Finally, the lamp was provided with an exterior lacquer dip coating 17 of cellulose acetate having a thickness of about 11 mils. In comparative performance testing, these lamps having a low conductivity inner coating of lanthanum borate glass exhibited an average improvement in light output of about 15% as compared to conventional flashlamps of the same type but without the inner coating.

Figure 3:
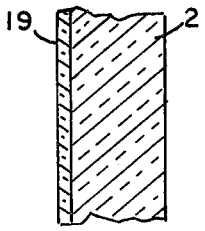
FIG. 3 is a greatly enlarged detail cross-section of a portion of the envelope wall of the lamp of FIG. 1, with the outer plastic coating being omitted for clarity.

In lieu of applying a coating of the low conductivity material, such as described above, the multilayer envelope structure may be provided by employing laminated glass sleeves having two or more layers of glass fused together. For example, the laminated glass may have a cross-section such as illustrated in FIG. 3 with a thin (e.g. one to three mils thick) layer 19 of selected low conductivity glass fused to a much thicker (e.g. 24 mils) layer 2 of conventional soft glass.

Another interesting approach is to combine the features of the present invention with the envelope strengthening characteristics of the lamp described in U.S. Pat. No. 3,676,043, assigned to the present assignee. According to that patent, an improved flashlamp structure is provided by employing a laminated envelope comprising three separate layers of glass fused to one another. The center layer of glass has a higher coefficient of thermal expansion than the inner and outer layers, with the result that the center layer is in tension and the outer layers are under compressive stress. As a result, the envelope is stronger than conventional single layer glass envelopes and more resistant to internal pressure when the lamp is flashed.

Figure 4:
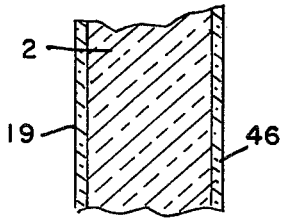
FIG. 4 is a greatly enlarged detail cross-section of an alternative embodiment of the envelope wall of FIGS. 1 and 3 showing a three-layer laminate, the outer plastic coating being omitted for clarity.

Hence, as illustrated in FIG. 4, a flashlamp in accordance with the teachings of both the present invention and U.S. Pat. No. 3,676,043 may have a three-layer laminated glass envelope. The primary (center) layer 2 would comprise a relatively thick (e.g., 24 mils or greater) layer of higher thermal expansion glass, while the inner and outer layers 19 and 46, respectively, would be quite thin (e.g. one to three mils) and have a lower coefficient of thermal expansion than the center layer 2. For example, the center layer 2 may have a thickness of about 24 mils and comprise Corning type 0080 glass having a coefficient of thermal expansion of approximately $92 \times 10^{-7}$ in./in./°C between 0° and 300°C. Inner layer 19 may be about 3 mils thick and comprise lead borogermanate glass of the composition set forth hereinbefore and having a measured coefficient of thermal expansion of about 68 to $70 \times 10^{-7}$ in./in./°C between 0° and 300°C. Finally, outer glass layer 46 may be about 3 mils thick and comprise the same glass as inner layer 19 or some other suitable glass having a coefficient of thermal expansion similar to that of inner layer 19. In this manner, the low conductivity of the inner layer will result in improved light output, and the compressive loading of the inner and outer layers will result in a stronger envelope.

Although the invention has been described with respect to specific embodiments, it will be appreciated that modifications and changes may be made by those skilled in the art without departing from the true spirit and scope of the invention. For example, in lieu of a fused layer 19, the low conductivity thermal barrier may comprise a tubular sleeve of the selected material of low thermal conductivity and diffusivity concentrically located within the lamp envelope.

What we claim is:

1. A photoflash lamp comprising:

an hermetically sealed, light-transmitting envelope;

a quantity of combustible material located in said envelope;

a combustion-supporting gas in said envelope, and ignition means attached to said envelope and disposed in operative relationship to said combustible material;

said envelope comprising a material selected to have a thermal conductivity of less than $24 \times 10^{-4}$ cal/cm-sec-°C at 100°C and a thermal diffusivity of less than $50 \times 10^{-4}$ cm²/sec at 100°C so as to minimize conductive heat losses through said envelope occuring during the collision of molten droplets of said combustible material with the inner wall of said envelope during flashing of said lamp, whereby losses in radiative energy resulting from said droplet-wall collisions are minimized.

2. The lamp of claim 1 wherein said envelope material is inorganic and has a thermal conductivity of less than about $20 \times 10^{-4}$ cal/cm-sec-°C at 100°C and a thermal diffusivity of less than about $30 \times 10^{-4}$ cm²/sec at 100°C.

3. The lamp of claim 2 wherein said envelope material comprises at least one member from the group consisting of lanthanum borate glasses and lead borate glasses.

4. The lamp of claim 1 wherein said envelope includes a primary layer of first material and an inner layer of a second material located between said combustible material and said primary layer, said inner layer consisting of said material having a thermal conductivity of less than $24 \times 10^{-4}$cal/cm-sec-°C at 100°C, said thermal conductivity of the inner layer being less than the thermal conductivity of said primary layer material.

5. The lamp of claim 4 wherein said inner layer material is inorganic.

6. The lamp of claim 6 wherein said primary layer material is glass, and the inner layer of said envelope comprises a light-transmitting coating on the inner surface of said glass primary layer.

7. The lamp of claim 6 wherein said coating has a thickness of at least about ten microns.

8. The lamp of claim 7 wherein said coating has a thickness of at least about one mil.

9. The lamp of claim 6 wherein said coating has a mean coefficient of thermal expansion which is substantially matched to or less than the mean coefficient of thermal expansion of said glass primary layer.

10. The lamp of claim 9 wherein the inner layer of said envelope is fused to the inner surface of said glass primary layer.

11. The lamp of claim 6 wherein said coating is inorganic and has a thermal conductivity of less than about $20 \times 10^{-4}$ cal/cm-sec-°C at 100°C and a thermal diffusivity of less than about $30 \times 10^{-4}$ cm²/sec at 100°C.

12. The lamp of claim 11 wherein said coating comprises at least one member from the group consisting of lanthanum borate glasses and lead borate glasses.

13. The lamp of claim 11 wherein the internal volume of said envelope is less than about one cubic centimeter, said combustible material is filamentary, the weight of said quantity of filamentary combustible material is at least about 18 milligrams, and the fill pressure of said combustion supporting gas is greater than about 500 centimeters of mercury.

14. The lamp of claim 1 wherein said envelope includes a primary layer of a first material and an inner layer of a second material located between said combustible material and said primary layer, said inner layer consisting of said material having a thermal conductivity of less than $24 \times 10^{-4}$ cal/cm-sec-°C at 100°C.

15. The lamp of claim 14 wherein said primary layer material is glass, and the inner layer of said envelope comprises a light-transmitting coating on the inner surface of said glass primary layer.

16. The lamp of claim 14 wherein said envelope is a laminate including at least two layers of glass fused together, one of said layers being said primary layer and another of said layers being said inner layer.

17. The lamp of claim 16 wherein said inner layer material has a thermal conductivity and thermal diffusivity which are respectively less than the thermal conductivity and diffusivity of said primary layer material.

18. The lamp of claim 16 wherein said inner layer material has a thermal conductivity of less than about $20 \times 10^{-4}$ cal/cm-sec-°C at 100°C and a thermal diffusivity of less than about $30 \times 10^{-4}$ cm²/sec at 100°C.

19. The lamp of claim 18 wherein said inner layer material comprises at least one member from the group consisting of lanthanum borate glasses and lead borate glasses.

20. The lamp of claim 16 wherein the coefficient of thermal expansion of said inner layer material is less than that of said primary layer material.

21. The lamp of claim 16 wherein said inner layer has a thickness of from about one to three mils, and said primary layer is several times thicker than said inner layer.

22. The lamp of claim 16 wherein said inner layer material has a thermal conductivity of less than about $20 \times 10^{-4}$ cal/cm-sec-°C at 100°C.

23. The lamp of claim 16 wherein said inner layer material has a thermal diffusivity of less than about $30 \times 10^{-4}$ cm²/sec at 100°C.

24. The lamp of claim 1 wherein said envelope material has a thermal conductivity of less than about $20 \times 10^{-4}$ cal/cm-sec-°C at 100°C.

25. The lamp of claim 1 wherein said envelope material has a thermal diffusivity of less than about $30 \times 10^{-4}$ cm²/sec at 100°C.

* * * * *